US006425164B2

(12) United States Patent
Stahlecker

(10) Patent No.: US 6,425,164 B2
(45) **Date of Patent: *Jul. 30, 2002**

(54) TRANSPORT BELT FOR TRANSPORTING A FIBER STRAND TO BE CONDENSED AND METHOD OF MAKING SAME

(75) Inventor: Fritz Stahlecker, Josef-Neidhart-Strasse18, 73337 Bad Ueberkingen (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 155 days.

This patent is subject to a terminal disclaimer.

(21) Appl. No.: 09/760,754

(22) Filed: Jan. 17, 2001

(30) Foreign Application Priority Data

Jan. 21, 2000 (DE) ..... 100 02 506
Jun. 14, 2000 (DE) ..... 100 29 301

(51) Int. Cl.[7] ..... D01H 5/86
(52) U.S. Cl. ..... 19/246; 19/150; 19/236
(58) Field of Search ..... 19/150, 236–250, 19/252, 263, 286–288, 304–308; 57/264, 304, 315, 328, 333; 156/137–139, 140, 143; 162/358.2, 900, 902–904; 198/689.1, 846, 847; 226/95, 170–173

(56) References Cited

U.S. PATENT DOCUMENTS 4,460,023 A * 7/1984 Mullaney ..... 139/383
4,758,309 A * 7/1988 Johansson ..... 162/358.2
4,784,190 A * 11/1988 Mullaney ..... 139/383
5,234,097 A * 8/1993 Okuyama ..... 198/689.1
5,543,015 A * 8/1996 Jermo ..... 198/847
5,857,605 A * 1/1999 Welch et al. ..... 226/95
5,911,307 A * 6/1999 Kraft et al. ..... 198/847
6,073,314 A * 6/2000 Barauke ..... 19/246
6,108,873 A 8/2000 Barauke ..... 19/236
6,116,156 A * 9/2000 Schiel et al. ..... 162/902
6,116,411 A * 9/2000 Reiner et al. ..... 198/847
6,170,126 B1 * 1/2001 Stahlecker ..... 19/246
6,173,831 B1 * 1/2001 Grabscheid et al. ..... 198/846

FOREIGN PATENT DOCUMENTS

DE 198 46 268 10/1999

* cited by examiner

*Primary Examiner*—John J. Calvert
*Assistant Examiner*—Gary L. Welch
(74) *Attorney, Agent, or Firm*—Crowell & Moring LLP

(57) ABSTRACT

An air-permeable transport belt, drivable by a drive roller, is provided for transporting a fiber strand to be condensed over a sliding surface of a spinning machine condensing zone which includes a suction slit. The transport belt has at least one area arranged to contact the drive roller, which area differs in relation to its surface structure from an area arranged to contact the sliding surface and from an area arranged to contact the fiber strand.

35 Claims, 4 Drawing Sheets

TRANSPORT BELT FOR TRANSPORTING A FIBER STRAND TO BE CONDENSED AND METHOD OF MAKING SAME

BACKGROUND AND SUMMARY OF THE INVENTION

This application claims the priority of German Patent Document 100 02 506.4, filed Jan. 21, 2000, and German Patent Document 100 29 301.8, filed Jun. 14, 2000, the disclosures of which are expressly incorporated by reference herein.

The present invention relates to an air-permeable transport belt drivable by a drive roller for transporting a fiber strand to be condensed over a sliding surface of a condensing zone of a spinning machine, said sliding surface comprising a suction sit.

For the condensing of a fiber strand leaving a drafting unit of a spinning machine it is important that the fiber strand is transported in the condensing zone disposed on an air-permeable transport element and still in a twist-free state and having fibers lying essentially parallel to one another, and that in the condensing zone an air stream is generated which flows through the transporting element, which air stream, depending on its width and/or direction influences the degree of condensing and which positions the fibers transversely to the transport direction and thus bundles or condenses the fiber strand. In the case of a fiber strand condensed in this way, a spinning triangle does not occur when twist is being imparted, so that the thread produced is more even, more tear-resistan, and less hairy.

The transport element plays a special role in condensing. In German published patent application DE 198 46 268 (corresponding U.S. Pat. No. 6,108,873), a transport element in the form of a perforated transport belt is described. This transport belt is designed as a circulating loop and slides on its inner side over a stationary sliding surface. The transport belt is driven on its outer side by means of friction.

The transport belt should be air-permeable where it guides the fiber strand, namely in the effective condensing area. The lateral areas of the transport belt, which do not run over the suction slit, do not necessarily need to be air-permeable. Their function is reliable transport by means of friction. On the other hand, the transport belt has to be in a position to slide over the sliding surface without any great friction.

It is an object of the present invention to design a transport belt of the above mentioned type so that it fulfills the requirements in relation to a friction drive and to sliding over a stationary sliding surface and at the same time functions reliably in the actual condensing area.

This object has been achieved in accordance with the present invention in that the transport belt comprises at least one area arranged to contact the drive roller, which area differs from an area arranged to contact the sliding surface and from an area arranged to contact the fiber strand in relation to its surface structure.

A transport belt of this type is designed differently over its effective width as well as in relation to its outer side and inner side, so that a type of zone belt is formed. In the air-permeable area, a good friction transport is not necessary, it is sufficient when the fiber strand to be condensed is transported reliably, which is already ensured by the air-permeability of the transport belt. Outside of the actual condensing area, in particular in the edge areas of the transport belt, the surface structure of the transport belt is designed for a good friction transport. At the same time, however, good sliding ability of the circulating transport belt is ensured as against the stationary sliding surface. The apparatus operating with the transport belt functions particularly well when the differences in friction between the drive roller and the transport belt on the one hand, and between the transport belt and the sliding surface on the other hand, are as large as possible. These friction pairings must be favorably influenced by relevant factors. The coefficient of friction between the transport belt and the sliding surface can be minimized by means of favorable surface coatings on the sliding surface and favorable designs of the transport belt. Advantageous is, for example, a sliding surface, which is slightly fluted in the direction of motion of the transport belt and has a roughness of 3 to 7 $\mu$m.

In the simplest embodiment, the area of the transport belt arranged to contact the sliding surface can, in relation to its surface structure, correspond to that area arranged to contact the fiber strand. In a further embodiment, it is, however, a contemplated to further optimize the transport belt in that the area arranged to contact the sliding surface can, with regard to its surface structure, also differ from the area arranged to contact the fiber strand.

With regard to the form, various types of transport belt are contemplated:

In one embodiment it is provided that the area arranged to contact the drive roller as well as the area arranged to contact the fiber strand are each placed on the outer side of the transport belt in the form of a circulating loop. This is, for example, for a transport belt according to the above mentioned prior art, when the transport belt loops on its inner side a suction channel comprising the sliding surface and is driven by a drive roller on its outer side.

In a further variation it can be provided that the area arranged to contact the drive roller and also the area arranged to contact the sliding surface is placed on the inner side of the transport belt in the form of a circulating loop. Such an embodiment is then practical when, for example, the transport belt hoops a drive roller.

For purely practical reasons, it is, as a rule, useful when the actual condensing area is located somewhat centrally to the transport belt. It is hereby sufficient when the transport belt is air-permeable only over a width corresponding to the width of the suction slit. In one embodiment of the present invention it is then provided that the at least one area arranged to contact the drive roller is an edge area of the transport belt.

In order to achieve a friction take along of the transport belt by means of the drive roller, a kind of positive engagement should be aimed for. For this reason it is provided in a further embodiment of the present invention that the at least one area arranged to contact the drive roller comprises a rough textured surface.

Because of the necessity of keeping the transport belt clean, there is a certain interest in designing the area arranged to contact the drive roller as narrow as possible in comparison to the other areas. The remaining area arranged to contact the fiber strand is less susceptible to fiber fly, particular when it is provided with a finely textured surface instead of a roughly patterned one. The area of the transport belt guiding the fiber strand may even be completely without any kind of textured surface, which is then the case when the air-permeable area of the transport belt is not perforated, but is simply porous.

The friction drive of the transport belt by means of the drive roller can be improved by the following measures:

The transport belt is thermally formed on the surface in such a way What a kind of fluting or the like occurs, with which, in connection with the resilience of the roller covering of the driving roller, a kind of positive engagement arises.

The transport belt is alternatively provided on both sides with an additional surface, which has a higher coefficient of friction, for example, a rubber coating.

The drive roller can also obtain special friction coatings, which are, for example, more resilient on the sides of the drive roller than in the center and/or which are somewhat enlarged in diameter. Thus the edge areas would be pressed somewhat harder against the transport belt.

These and further objects, features and advantages of the present invention will become more readily apparent from the following detailed description thereof when taken in conjunction with the accompanying drawings.

DETAILED DESCRIPTION OF THE DRAWINGS

Figure 1:
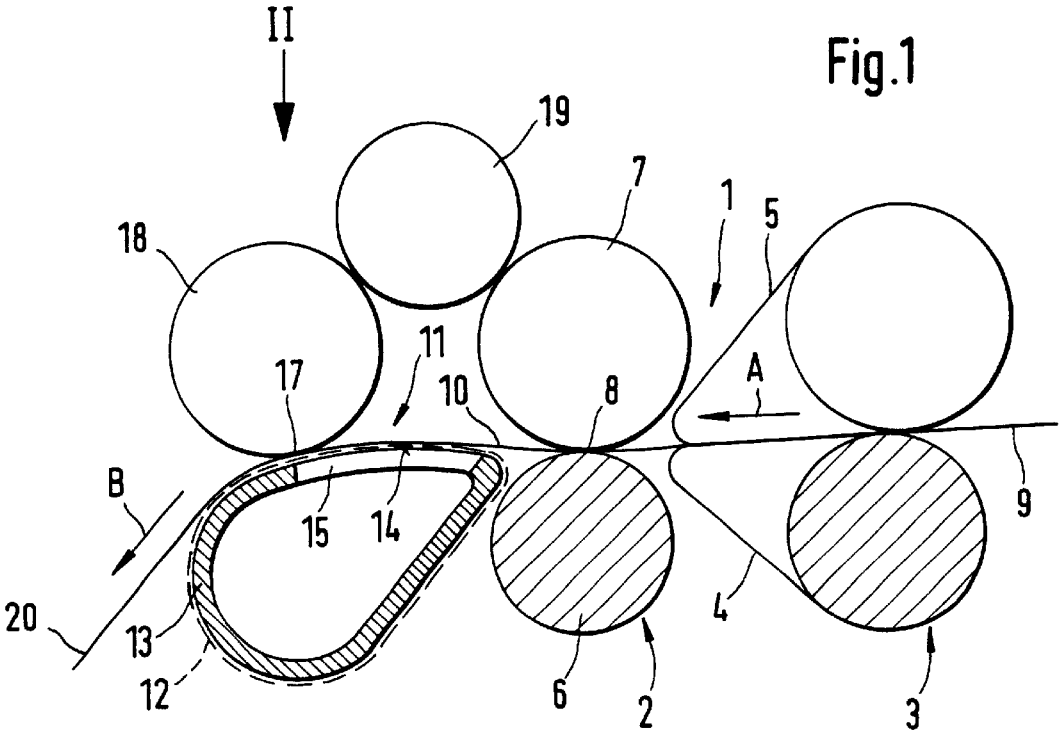
FIG. 1 is a partly sectional side view onto the area of a condensing zone of a spinning machine, constructed according to preferred embodiments of the invention.
Figure 2:
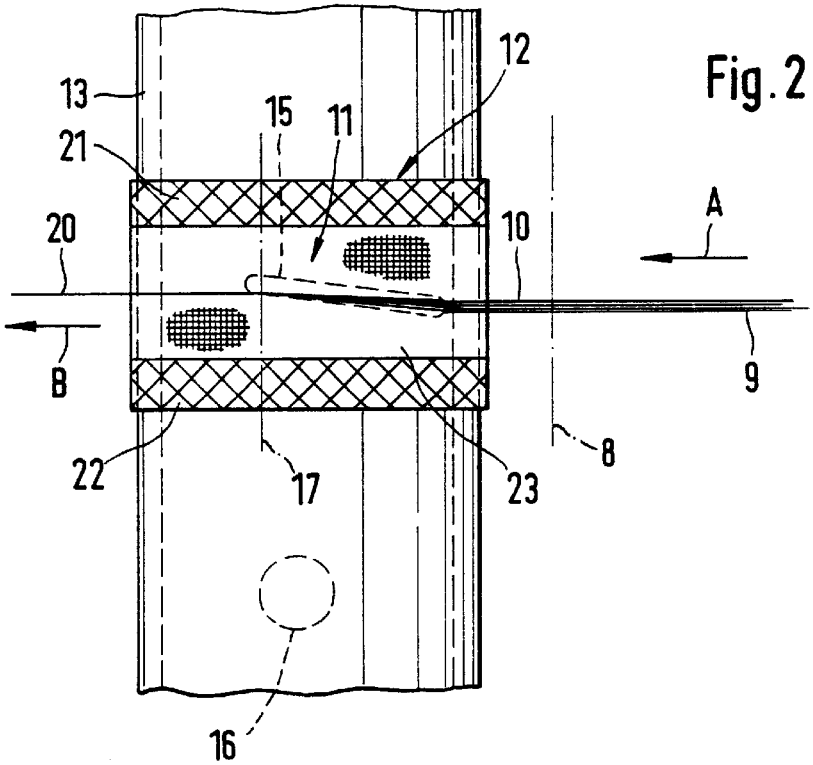
FIG. 2 is a view in the direction of the arrow II of FIG. 1 onto the condensing zone.

In FIGS. 1 and 2, only the delivery area and the area of a drafting unit 1 downstream thereof of a spinning machine, for example a ring spinning machine, are shown. The drafting unit 1 comprises a front roller pair 2 as well as an apron roller pair 3 upstream thereof, comprising a bottom apron 4 and an upper apron 5. The front roller pair 2 comprises a bottom roller 6 and a pressure roller 7 arranged thereto, whereby the bottom roller 6 is designed as a driven bottom cylinder extending continuously in machine longitudinal direction, and the pressure roller 7 is designed simply as a roller arranged to one spinning station. The front roller pair 2 defines a front nipping line 8, at which the drafting zone of the drafting unit 1 ends.

In the drafting unit 1, a sliver or roving 9 is drafted in a known way in transport direction A to the desired degree of fineness. Downstream of the front roller pair 2, a drafted but still twist-free fiber strand 10 is present, which is to be concerned in a condensing zone 11 downstream of the drafting unit 1.

An air-permeable transport belt 12 is arranged at the condensing zone 11, which transport belt 12 transports the fiber strand 10 to be condensed. This transport belt 12 should be perforated or porous in the effective area in which the condensing takes place, and should guide the fiber strand 10. It is hereby in principle contemplated to use transport belts 12 made of a standard apron material or made of textile or synthetic threads.

A suction channel 13 is a further component of the condensing zone 11, which suction channel 13 can consist of one hollow profile extending over a plurality of spinning stations, and which is set in a vacuum by means of a vacuum conduit 16. The outer contour of the suction channel 13 facing the transport belt 12 is designed as a sliding surface 14, on which the circulating transport belt 12 is disposed. A suction slit 15, pertaining to the condensing zone 11, is located in the sliding surface 14, which suction slit 15 extends essentially in transport direction A, preferably slightly inclined thereto. The end of the condensing zone 11 is defined by a delivery nipping line 17, which functions simultaneously as a twist block.

The delivery nipping line 17 comes into being by means of the drive roller 18 being pressed to the sliding surface 14. The transport belt 12, which is designed as a circulating loop, is caused by the driving roller 18 to be driven by means of friction on its outer side. The drive roller 8 in turn receives its drive from the pressure roller 7 by means of a transfer roller 19.

Directly downstream of the delivery nipping line 17, the thread 20 to be spun receives its spinning twist, in which it is fed in delivery direction B to a twist device, for example, a ring spindle. The spinning twist imparted by the twist device cannot run back beyond the delivery nipping line 17 into the condensing zone 11.

The transport belt 12 is, as can be seen from FIG. 1, placed on the suction channel 13. It must be ensured that during operation, the braking effect on the transport belt 12 is as low as possible and that on the other hand, ensured by means of a suitable friction drive, the take-along of the transport belt 12 by means of the drive roller 18 is as slip-free as possible. The inner side of the transport belt 12 which slides over the sliding surface 14 must be adapted to the surface of the suction channel 13. The latter can be provided with coatings, which ensure a very low sliding friction. A certain degree of fine texturing is possible hereby, with the aim of preventing a so-called glass pane effect. A texturing of this kind should, however, lie only in the order of magnitude of approximately 0.1 mm.

There are thus, with regard to the transport belt 12, various requirements to be met, namely on the one hand to permit the lowest friction possible for the sliding action on the sliding surface 14 and on the other hand to enable a friction drive by the drive roller 18. This is achieved in accordance with the present invention in that the transport belt 12 is divided into different areas or zones, which fulfill the above mentioned requirements.

According to FIG. 2, the lateral areas 21 and 22 of the transport belt 12, which do not travel over the suction slit 15 and as a result do not need to be air-permeable, are provided with a rough textured surface which is suitable for the drive by means of the drive roller 18. The most favorable textured surface is one which comes the closest to a positive engagement. The central area 23, arranged to contact the fiber strand 10 to be condensed, is, in contrast, adapted in its texture to the fiber material. A possible perforation should not be too large with regard to its diameter, so that no fibers can remain lodged in the transport belt 12 or enter into the suction channel 13. The edge areas 21 and 22 arranged to contact the drive roller 18 are differently designed with regard to their surface structure as compared to the central area 23 arranged to contact the fiber strand 10. The inner side of the transport belt 12 facing the sliding surface 14 is, in contrast, designed in such a way that a low friction sliding is possible, as is explained below with the aid of FIGS. 12 to 14. This can frequently be the case when the surface structure of the area arranged to contact the sliding surface 14 has similar properties to the area 23 arranged to contact the fiber strand 10.

Because of the necessity of keeping the transport belt 12 clean, there is a certain interest in designing the relatively roughly textured edge areas 21 and 22 arranged to contact the drive roller 18 as narrow as possible.

In the embodiment according to FIGS. 1 and 2, it is provided that the areas 21, 22 arranged to contact the drive roller 18 as well as the central area 23 arranged to contact the fiber strand 10 are each placed on the outer side of the transport belt 12. Alternatively a geometry, described below with the aid of FIGS. 3 and 4, is also contemplated.

Figure 3:
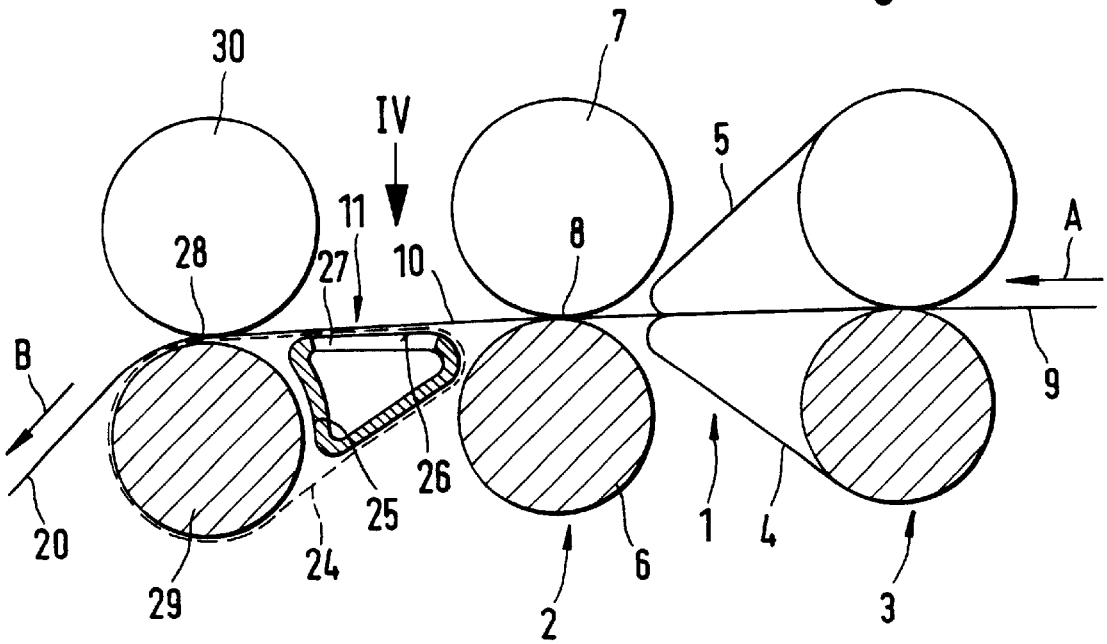
FIG. 3 is a side view similar to FIG. 1 of a further embodiment of a condensing zone.
Figure 4:
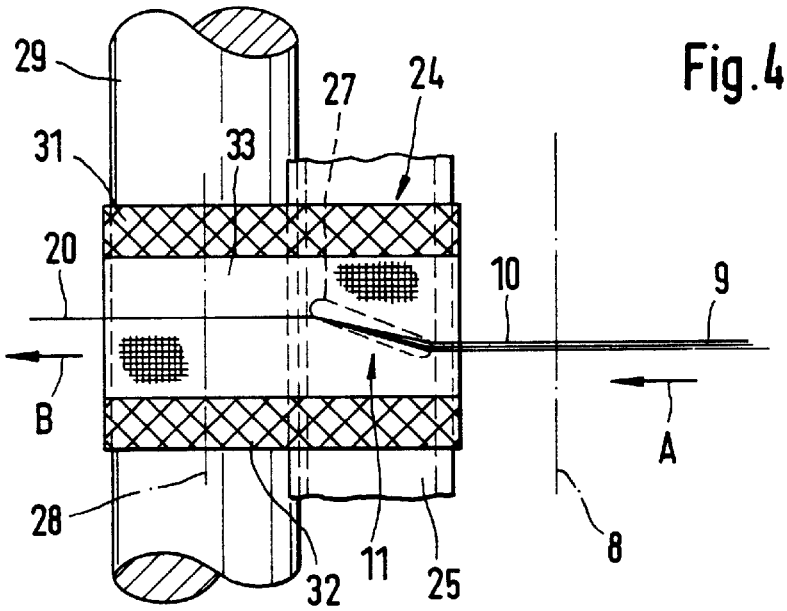
FIG. 4 is a view in the direction of the arrow IV of FIG. 3.

In the embodiment according to the FIGS. 3 and 4, the same previous reference numbers are used again when an identical component is involved. A repeat description of these components can be omitted.

In the embodiment according to FIGS. 3 and 4, a somewhat differently designed transport belt 24 is arranged to contact the condensing zone 11, which transport belt 24 loops a driven, continuous drive roller 29 extending in machine longitudinal direction, and which is driven thereby. In the inside of the loop a suction channel 25 is again located, whose outer contour facing the condensing zone 11 takes the form of a sliding surface 26. The sliding surface 26 also comprises a suction slit 27 here, so that the transport belt 24 must be air-permeable.

The drive roller 29 defines by means of a delivery pressure roller 30 disposed thereon, a delivery nipping line 28, which borders the condensing zone 11 on its exit side and which again functions as a twist block.

The transport belt 24 is again provided with the roughly textured edge areas 31 and 32 which serve the friction drive, and which are arranged to contact the drive roller 29. in contrast, only a central area 33 arranged to contact the fiber strand 10 is air-permeable, but is otherwise either not finely textured or only slightly.

In contrast to the embodiment according to FIGS. 1 and 2, it is provided in the embodiment according to FIGS. 3 and 4 that the areas 31 and 32 arranged to contact the drive roller 29 as well as the area arranged to contact the sliding surface 26 are both arranged on the inside of the transport belt 24.

In the following Figures a series of embodiments of transport belts are described, whereby it is presumed first and foremost that these transport belts are applied for an arrangement according to FIGS. 1 and 2. Analogous arrangements according to the FIGS. 3 and 4 is also contemplated.

Figure 5:
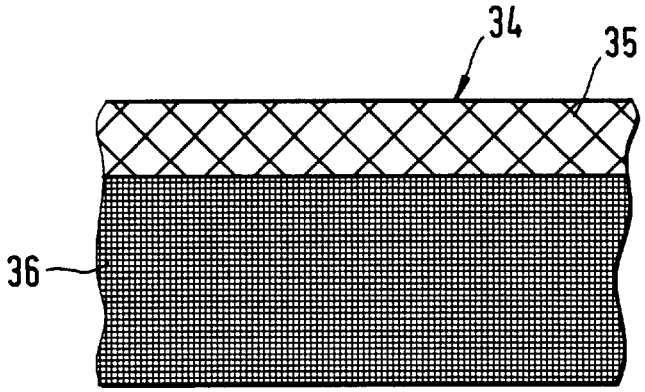
FIGS. 5 to 11 are plan views of sections of different embodiments of transport belts with regard to their surface structure in an area arranged to contact the fiber strand and in at least one area arranged to contact the drive roller, each in a view taken in the same direction as FIG. 2.

The transport belt 34 according to FIG. 5 is only air-permeable in the area 36 arranged to contact the fiber strand 10, and not in the edge area 35 arranged to contact the drive roller 18. The area 36 arranged to contact the fiber strand 10 consists of a thin, close-meshed woven fabric, whereby the air permeability of the transport belt 34 occurs inevitably. The edge area 35, which serves the friction drive is, in the present case, only one-sided and furthermore relatively narrow, which facilitates cleaning overall. The area 35 arranged to contact the drive roller 18 has a relatively rough texturing, while the area 36 arranged to contact the fiber strand 10 is, due to the form of the woven fabric, very finely textured.

Figure 6:
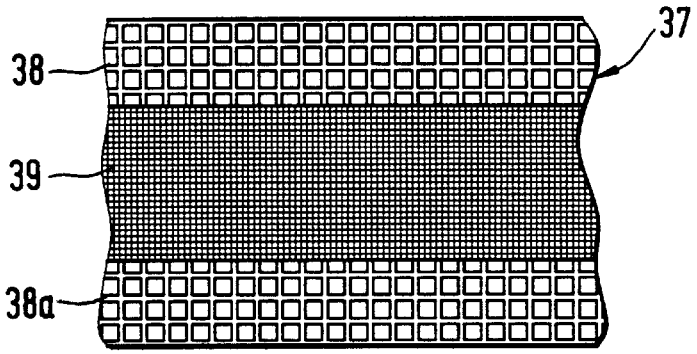

The same applies to the transport belt 37 designed somewhat differently as shown in FIG. 6. Here the central area 39 arranged to contact the fiber strand 10 is again a very fine-meshed woven fabric, while on each side thereof, an edge area 38,38*a* arranged to contact the drive roller 18 is provided, which is designed as a rough lattice weave with regard to providing a good take-along. The area 39 arranged to contact the fiber strand 10, in contrast, consists of a woven fabric made of significantly finer filament threads.

Figure 7:
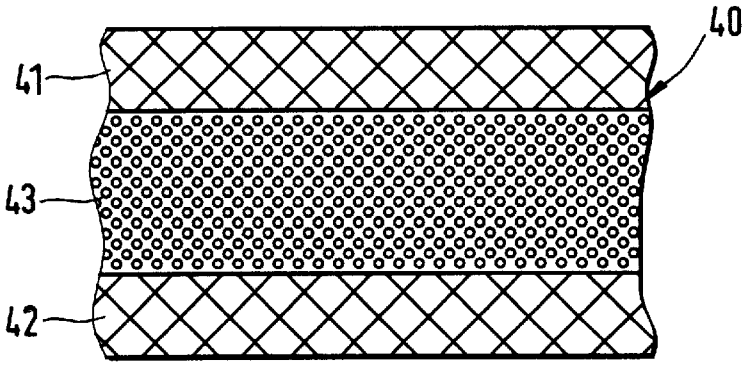

The transport belt 40 according to FIG. 7 comprises a central area 43 arranged to contact the fiber strand 10 and provided with narrow perforations, and edge areas 41 and 42 which serve the friction drive, which areas 41 and 42 have a waffle-like structure. This is very slightly elevated in design, for example, 0.1 mm, similar to knurled cylinders in drafting units.

Figure 8:
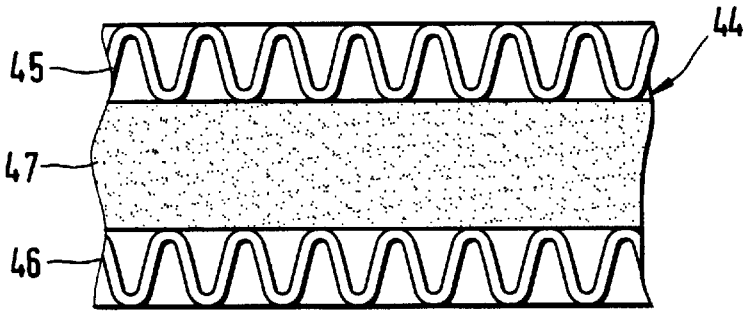

The transport belt 44 according to FIG. 8 comprises a central, non-textured area 47 arranged to contact the fiber strand 10, which area 47 is not perforated but rather is simply porous. The lateral edge areas 45 and 46 arranged to contact the drive roller 18 have, in contrast, a meandering pattern, which can be slightly elevated.

Figure 9:
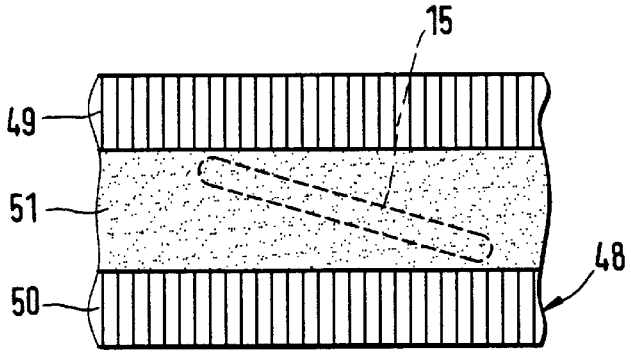

In the transport belt 48 according to FIG. 9, both edge areas 49 and 50 arranged to contact the drive roller 18 are provided with a fluted pattern, which extends transversely. The central area 51, which is arranged to contact the fiber strand 10 is, in contrast, again a non-textured porous area. In this FIG. 9 the suction slit 15 located under the transport belt 48 is drawn in, so that it is clear that the width of the air-permeable area 51 may correspond only to the width of the suction affected by the suction slit 15. The later alternative applies similarly also to all other embodiments.

Figure 10:
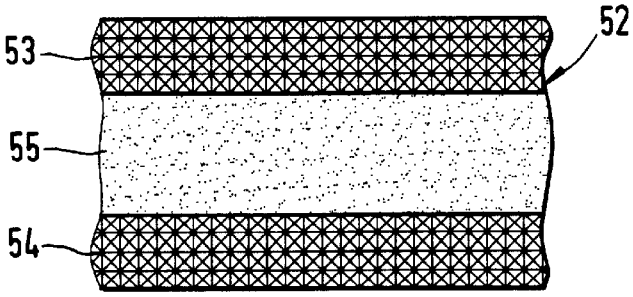

The transport belt 52 according to FIG. 10 has in each of its edge areas 53 and 54 arranged to contact the drive roller 18 a rough texturing in the form of small pyramids, while the central area 55 arranged to contact the fiber strand 10 is again porous, without any perceptible textured surface.

Figure 11:
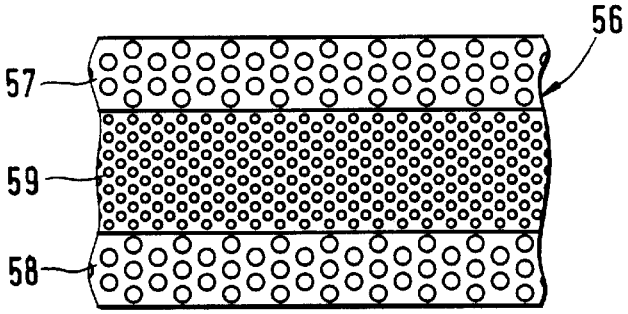

Finally, in FIG. 11 a transport belt 56 is shown, whose central area 59 arranged to contact the fiber strand 10 has very fine perforations, while the edge areas 57 and 58 arranged to contact the drive roller 18 have relatively rough perforations, which permit a good take-along.

It should be expressly mentioned here that, of course, as regards the individual areas of the transport belts, all possible combinations of the embodiments described above are contemplated.

Figure 12:
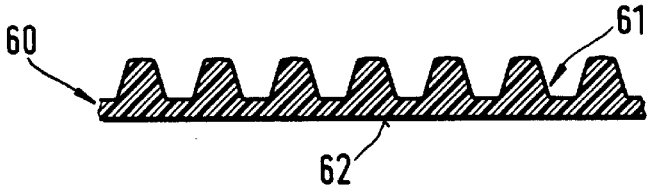
FIGS. 12 to 14 are greatly enlarged views of differently designed transport belts similar to he belt of FIG. 1, and having differently structured surfaces in an area arranged to contact the sliding surface and in an area arranged to contact the drive roller.
Figure 13:
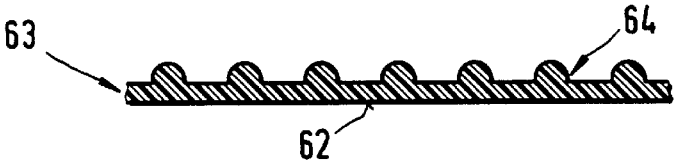
Figure 14:
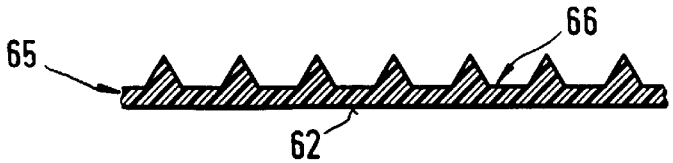

The greatly enlarged views of the transport belts 60,63 and 65 as shown in FIGS. 12, 13 and 14 show that the area 62 arranged to contact the sliding surface 14 is so designed that sliding is as friction-free as possible. What is involved here, insofar as the embodiment according to FIGS. 1 and 2 is concerned, is the inner side of the respective transport belt. On the drive side, in contrast, the areas 61,64 or 66 arranged to contact the drive roller 18 are all textured, whereby the FIGS. 12 to 14 show only a few embodiment-examples. Important in all cases which in the present case apply to the variations according to FIGS. 1 and 2, is that the transport belts 60,63 or 65 serve on their outer sides a friction drive, and on their inner sides have an area 62 which permits sliding which is as friction-free as possible.

The respective textured edge areas or zones should be adapted to the respective coating of the drive roller 18 or 29. It can be favorable to apply sufficiently resilient drive roller 18,29 coating, so that the coating can press into the rough texture of the respective transport belt 12 or 24. In an extreme case it would be possible to provide the lateral areas of the respective drive rollers 18, 29 with a fluting and to provide the edge areas of the transport belt 12, 24 arranged thereto with a corresponding textured surface, so that an interlocking occurs. It is even contemplated to permit the drive to take place by means of a correct interlocking. In such a case the drive roller 18 or 29 could be made of metal, or at least its edge areas. An embodiment in plastic is, of course, also contemplated.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An air-permeable transport belt derivable by a drive roller for transporting a fiber strand to be condensed over a sliding surface comprising a suction slit of a spinning machine condensing zone, wherein the transport belt comprises at least one area arranged to contact the drive roller which differs with regard to its surface structure from an area arranged to contact the sliding surface as well as from an area arranged to contact the fiber strand.

2. A transport belt according to claim 1, wherein the area arranged to contact the sliding surface differs from the area arranged to contact the fiber strand with regard to its surface structure.

3. A transport belt according to claim 2, wherein the area arranged to contact the drive roller as well as the area arranged to contact the fiber strand are each arranged at an outer side of the transport belt, which belt is in the form of a circulating loop.

4. A transport belt according to claim 2, wherein the area arranged to contact the drive roller as well as the area arranged to contact the sliding surface are both arranged on the inner side of he transport belt which is in the form of a circulating loop.

5. A transport belt according to claim 2, wherein the at least one area arranged to contact the drive roller is an edge area of the transport belt.

6. A transport belt according to claim 2, wherein the at least one area arranged to contact the drive roller has a rough textured surface.

7. A transport belt according to claim 2, wherein the at least one area arranged to contact the drive roller is designed to be narrower in comparison to other areas of the transport belt.

8. A transport belt according to claim 1, wherein the area arranged to contact the drive roller as well as the area arranged to contact the fiber strand are each arranged at an outer side of the transport belt, which belt is in the form of a circulating loop.

9. A transport belt according to claim 8, wherein the at least one area arranged to contact the drive roller is an edge area of the transport belt.

10. A transport belt according to claim 8, wherein the at least one area arranged to contact the drive roller has a rough textured surface.

11. A transport belt according to claim 8, wherein the at least one area arranged to contact the drive roller is designed to be narrower in comparison to other areas of the transport belt.

12. A transport belt according to claim 1, wherein the area arranged to contact the drive roller as well as the area arranged to contact the sliding surface are both arranged on the inner side of the transport belt which is in the form of a circulating loop.

13. A transport belt according to clam 2, wherein the at least one area arranged to contact the drive roller is an edge area of the transport belt.

14. A transport belt according to claim 12, wherein the at least one area arranged to contact the drive roller has a rough is textured surface.

15. A transport belt according to claim 12, wherein the at least one area arranged to contact the drive roller is designed to be narrower in comparison to other areas of the transport belt.

16. A transport belt according to claim 1, wherein the at least one area arranged to contact the drive roller is an edge area of the transport belt.

17. A transport belt according to claim 16, wherein the at least one area arranged to contact the drive roller is designed to be narrower in comparison to other areas of the transport belt.

18. A transport belt according to claim 1, wherein the at least one area arranged to contact the drive roller has a rough textured surface.

19. A transport belt according to claim 8, wherein the at least one area arranged to contact the drive roller is designed to be narrower in comparison to other areas of the transport belt.

20. A transport belt according to claim 1, wherein the at least one area arranged to contact the drive roller is designed to be narrower in comparison to other areas of the transport belt.

21. A transport belt according to claim 1, wherein the area arranged to contact the fiber strand is provided with a fine textured surface.

22. A transport belt according to claim 1, wherein the area arranged to contacts the fiber strand has a non-textured surface.

23. A transport belt according to claim 1, wherein only the areas arranged to contact the fiber strand and the sliding surface are air-permeable.

24. A transport belt according to claim 23, wherein the air-permeable area corresponds to the width of the suction affected by the suction slit.

25. A method of making an air-permeable transport belt which in use is derivable by a drive roller and operable to transport a fiber strand over a sliding surface of a spinning machine condensing zone, said method comprising:

forming an endless belt, and providing respective different surface structures on the endless belt for the following areas of the endless belt:

(i) an area which in use contacts the drive roller;

(ii) an area which in use contacts the sliding surface; and (iii) an area which in use contacts the fiber strand.

26. A method of making an air-permeable transport belt according to claim 25, wherein the area arranged to contact the sliding surface differs from the area arranged to contact the fiber strand with regard to its surface structure.

27. A method of making an air-permeable transport belt according to claim 25, wherein the area arranged to contact the drive roller as well as the area arranged to contact the fiber strand are each arranged at an outer side of the transport belt, which belt is in the form of a circulating loop.

28. A method of making an air-permeable transport belt according to claim 25, wherein the area arranged to contact the drive roller as well as the area arranged to contact the sliding surface are both arranged on the inner side of the transport belt which is in the form of a circulating loop.

29. A method of making an air-permeable transport belt according to claim 25, wherein the at least one area arranged to contact the drive roller is an edge area of the transport belt.

30. A method of making an air-permeable transport belt according to claim 25, wherein the at least one area arranged to contact the drive roller has a rough textured surface.

31. A method of making an air-permeable transport belt according to claim 25, wherein the at least one area arranged to contact the drive roller is designed to be narrower in comparison to other areas of the transport belt.

32. A method of making an air-permeable transport belt according to claim 25, wherein the area arranged to contact the fiber strand is provided with a fine textured surface.

33. A method of making an air-permeable transport belt according to claim 25, wherein the area arranged to contact the fiber strand has a non-textured surface.

34. A method of making an air-permeable transport belt according to claim 25, wherein only the areas arranged to contact the fiber strand and the sliding surface are air-permeable.

35. A method of making an air-permeable transport belt according to claim 34, wherein the air-permeable area corresponds to the width of the suction effected by the suction slit.

* * * * *